US006290215B1

(12) United States Patent
Pinsker

(10) Patent No.: US 6,290,215 B1
(45) Date of Patent: Sep. 18, 2001

(54) CARBURETOR WITH PRESSURIZED FUEL INJECTORS

(76) Inventor: Michael Pinsker, 1369 Home Ave., Fortuna, CA (US) 95540

( * ) Notice: Subject to any disclaimer, the term of this patent is extended or adjusted under 35 U.S.C. 154(b) by 0 days.

(21) Appl. No.: 09/500,580

(22) Filed: Feb. 10, 2000

(51) Int. Cl.[7] ..... F02M 9/12

(52) U.S. Cl. ..... 261/23.2; 123/439; 123/470; 261/76; 261/DIG. 56; 261/DIG. 74

(58) Field of Search ..... 261/23.2, 76, DIG. 56, 261/DIG. 74, DIG. 78; 123/439, 470, 471

(56) References Cited

U.S. PATENT DOCUMENTS

| | | | | |
|---|---|---|---|---|
| 2,525,083 | * | 10/1950 | Stresen-Reuter | 261/DIG. 56 |
| 3,778,038 | | 12/1973 | Eversole et al. | 261/50 R |
| 3,931,368 | | 1/1976 | Barker et al. | 261/36 A |
| 3,965,221 | * | 6/1976 | Englert et al. | 261/23.2 |
| 4,021,513 | * | 5/1977 | Ullman | 261/DIG. 56 |
| 4,056,583 | | 11/1977 | Shinoda et al. | 261/36 A |
| 4,125,095 | * | 11/1978 | Wilson | 261/DIG. 56 |
| 4,283,355 | | 8/1981 | Herd, Jr. et al. | 261/44 F |
| 4,289,104 | * | 9/1981 | Takada et al. | 261/DIG. 78 |
| 4,308,835 | * | 1/1982 | Abbey | 261/DIG. 56 |
| 4,327,675 | * | 5/1982 | Takeda | 261/DIG. 74 |
| 4,420,438 | | 12/1983 | Goosen | 261/65 |
| 4,482,507 | | 11/1984 | Kendig | 261/39 D |
| 4,493,804 | | 1/1985 | Narkamura et al. | 261/44 C |
| 5,126,079 | | 6/1992 | Nagamatsu | 261/44 |
| 5,809,972 | * | 9/1998 | Grant | 261/23.2 X |

FOREIGN PATENT DOCUMENTS

| | | | | |
|---|---|---|---|---|
| 55-49566 | * | 4/1980 | (JP) | 261/DIG. 78 |

* cited by examiner

*Primary Examiner*—Richard L. Chiesa
(74) *Attorney, Agent, or Firm*—Patent & Trademark Services; Thomas Zack; Joseph H. McGlynn

(57) ABSTRACT

A premixing fuel-air chamber for use with the manifold of a combustion chamber of an engine. The chamber has a hollow interior housing that has an air intake inlet on one side and a fuel-air outlet on the opposite side of the housing. Within the confines of the housing is a laminar air flow wing fixed to the housing and used to divide the interior of the housing into two air passageways. Operatively associated with the air flow wing are two movable side mounted air throttle valves, also fixed to the interior of the housing. These valves move in unison to open or block the two air passageways formed by the laminar air flow wing. Nearer the fuel-air outlet of the housing, below the wing, are two pressurized side fuel injectors mounted to inject a spray of fuel within the interior of the housing adjacent the fuel-air outlet. The actual mixing of the injected fuel and intake air is done prior to the combustion chamber, which chamber may be part of an existing engine. This design permits the air introduced into the housing to flow at a very high velocity within the premixing chamber.

7 Claims, 2 Drawing Sheets

CARBURETOR WITH PRESSURIZED FUEL INJECTORS

BACKGROUND OF THE INVENTION

This invention relates to a premixing chamber having fuel injectors, an air intake, a laminar air flow wing and air throttle valves that supply air and fuel to the manifold of an engine for mixing.

Carburetors that deliver a fuel-air mixture to the combustion chamber of an engine are very well known. Typically, the carburetor has a chamber housing with at least one air intake port and a fuel intake. When a fuel injector is used, the fuel is introduced under pressure into the housing to form the fuel-air mixture which mixture is in communication with the engines combustion chamber.

In one prior art invention, the combustible mixture of air and minute fuel droplets is accurately controlled over the operating range of the engine. To provide this control a constricted zone is used to increase the velocity of the mixture to sonic speed. Downstream of the sonic zone is a supersonic zone which accelerates the mixture from the sonic zone to a supersonic velocity without substantial turbulent flow. This accelerated mixture is then decelerated to a subsonic velocity in a subsonic zone to produce a shock where the fuel droplets subdivide and are uniformly distributed before the mixture is supplied to the engine cylinders.

Another prior art fuel flow proportioning valve of the variable area venturi type carburetor uses a movable wall to vary the venturi area. Part of the flow fuel tubes are discharged adjacent the venturi throat and the remaining proportion of fuel is returned to the pump. In one variable venturi carburetor movable members are linked with and driven by the accelerating pedal to vary the area of the throat opening.

Another carburetor variety has a fuel spray bar extending across the throttle with transversely oppositely disposed fuel orifices. This same carburetor has a pair of venturi plates mounted for pivotal movement about individual axes moving relative to a bar to define an adjustable throat.

With a carburetor throttle valve apparatus invention a pair of spherical segments with center openings are attached to either side of an existing throttle plate and throttle shaft. These segments have grooves on one side to fit the throttle shaft which has a generally lenticular shape to act as an air foil.

A sonic carburetor invention has a air-fuel mixing passageway with a fuel dispersion bar in the passageway. A plurality of fuel dispersion openings in the bar inject fuel into the passageway.

Still another invention discloses a variable venturi-type carburetor having a suction piston with a tip face.

Another more recent carburetor invention provides for direct mechanical control of both the airflow valve and the fuel dispersion assembly. A three bar linkage connects the airflow valve to the fuel dispersion assembly. The operation of a throttle valve in the carburetor affects the position of the airflow valve.

DESCRIPTION OF THE PRIOR ART

Carburetors and fuel injector have been constructed in a variety of different ways. For example, in the U.S. Pat. No. 3,778,038 to Eversole et al there is disclosed a combustible mixture of air and minute fuel droplets which is accurately controlled over the operating range of the engine. To provide this control a constricted zone is used to increase the velocity of the mixture to sonic speed. Downstream of the sonic zone is a supersonic zone which accelerates the mixture from the sonic zone to a supersonic velocity without substantial turbulent flow. This accelerated mixture is then decelerated to a subsonic velocity in a subsonic zone to produce a shock where the fuel droplets subdivide and are uniformly distributed before the mixture is supplied to the engine cylinders.

U.S. Pat. No. 3,931,368 to Barker et al. discloses a fuel flow proportioning valve of the variable area venturi type carburetor using a movable wall to vary the venturi area. Part of the flow fuel tubes are discharged adjacent the venturi throat and the remaining proportion of fuel is returned to the pump.

U.S. Pat. No. 4,056,583 to Shinoda et al. discloses a variable venturi carburetor having movable members linked with and driven by the accelerating pedal to vary the area of the throat opening.

U.S. Pat. No. 4,283,355 to Herd, Jr., et al. discloses a fuel spray bar extending across the throttle with transversely oppositely disposed fuel orifices. This same carburetor has a pair of venturi plates mounted for pivotal movement about individual axes moving relative to a bar to define an adjustable throat.

U.S. Pat. No. 4,420,438 to Goosen discloses a carburetor throttle valve apparatus invention with a pair of spherical segments with center openings attached to either side of an existing throttle plate and throttle shaft. These segments have grooves on one side to fit the throttle shaft which has a generally lenticular shape to act as an air foil.

U.S. Pat. No. 4,482,507 to Kendig discloses a sonic carburetor invention with an air-fuel mixing passageway and a fuel dispersion bar in the passageway. A plurality of fuel dispersion openings in the bar inject fuel into the passageway.

U.S. Pat. No. 4,493,804 to Nakamura et al. discloses a variable venturi-type carburetor having a suction piston with a tip face.

U.S. Pat. No. 5,126,079 to Nagamatsu discloses a direct mechanical control of both the airflow valve and the fuel dispersion assembly. A three bar linkage connects the airflow valve to the fuel dispersion assembly. The operation of a throttle valve in the carburetor affects the position of the airflow valve.

In the present invention a premixing chamber has multiple fuel injectors, a controlled air throttle, a laminar wing and two throttle valves pivotally mounted parallel to the laminar wing, all as will be detailed in the specification that follows hereafter.

SUMMARY OF THE INVENTION

This invention relates to a fuel-air premixing chamber having two opposed fuel injectors downstream of two pivotally mounted air throttle valves which can engage an air flow wing to control the laminar air flow input of the chamber.

It is the primary object of the present invention to provide for an improved fuel-air premixing chamber.

Another object is to provide for such a fuel-air premixing chamber that has two opposed fuel injectors and related air throttle valves to control the flow of air.

These and other objects and advantages of the present invention will become apparent to readers from a consideration of the ensuing description and the accompanying drawings.

DESCRIPTION OF THE PREFERRED EMBODIMENT

Figure 1:
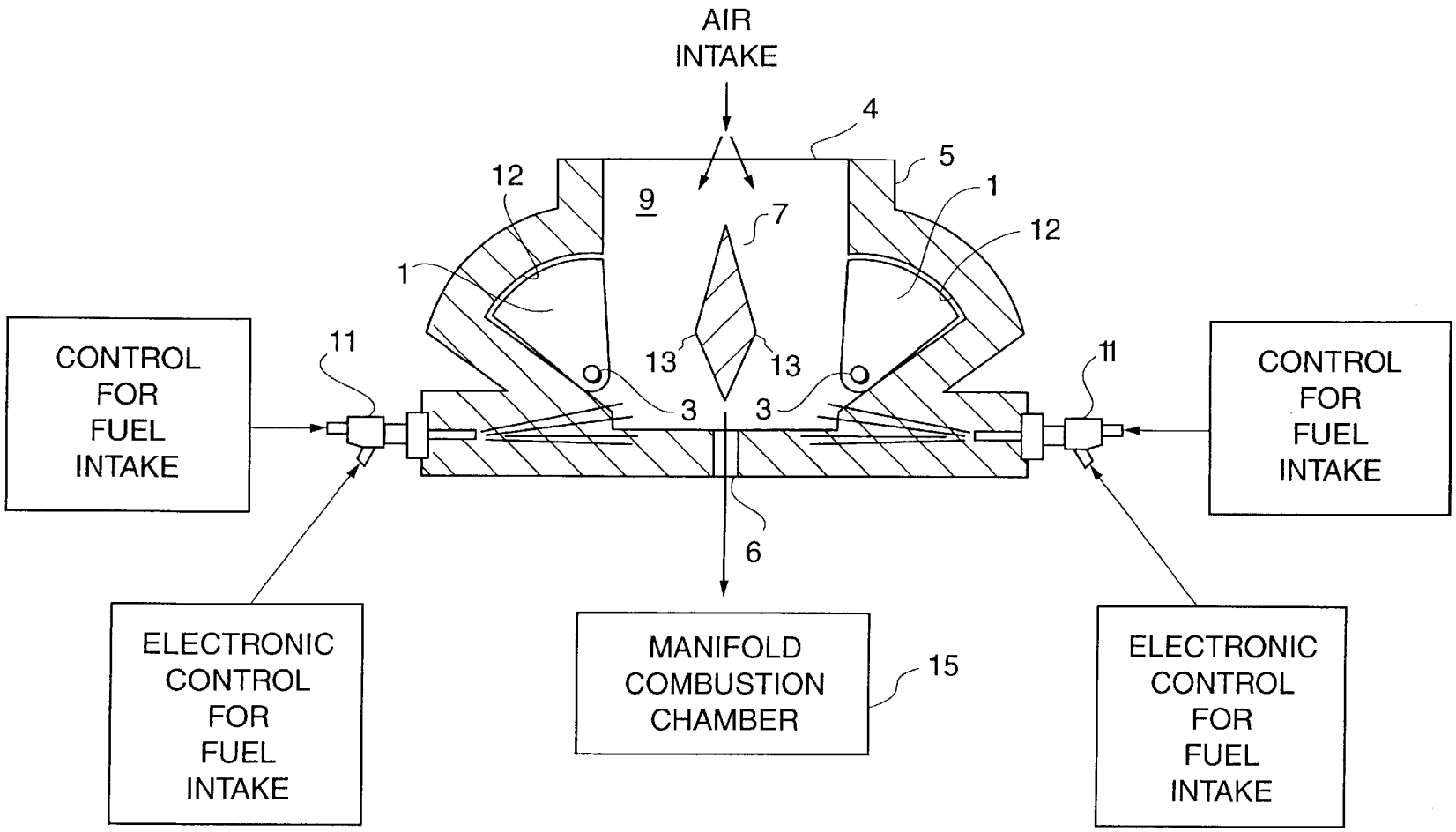
FIG. 1 is a side cross section view of the invention with the air throttle valves in an opened position.

FIG. 1 is a side cross section view of the invention with the two opposed identically shaped air throttle valves 1 in an opened position. Each valve 1 has a pivotal pin 3 to mount the valve to the supporting structure of the housing 5. Housing 5 has an upper air intake 4 and a lower opposite side fuel-air outlet 6. Between the two valves 1 is the laminar air flow wing 7. Center passageway wing 7 is fixed to the supporting wall of the housing 5 and the wing is diamond shaped with two of the opposing diamond points being vertically disposed relative to the incoming air flow pattern. Wing 7 acts to divide the passageway into two approximately equal passageways for the incoming air.

An internal hollow fuel-air premixing chamber 9 is formed between the interior walls of the housing 5 below the wing 7. This lower portion of chamber 9 is in fluid communication with the divided air intake and the fuel outputs from the two side fuel injectors 11. These injectors are mounted in the housing with their output ends extending into the interior chamber 9. The injected fuel from the injectors 11 may be provided under pressure to the lower part of chamber 9 in the form of fuel droplets. These droplets can be droplets of fuel or a fuel-air mixture provided for within the confines of the injector units.

The purpose of the center passageway air flow wing 7 is to insure that any input air supplied to the lower portion of chamber 9, where the fuel from the injectors is supplied to the air intake air, flows in a laminar flow pattern. As shown in this first figure, the housing has internal side valve seating cut out portions 12 which permit the two throttle valves 11 to move completely out of the two side air passageways formed by the center laminar flow wing 7 within the housing. Each cut out portion 12 has substantially the same size and shape as the triangularly shaped valve 12 such that when completely opened, as shown in FIG. 1, the valve's exposed side present a smooth, unobstructed, and aligned surface with the internal form housing air intake passageway.

The wing sides 13 protrude into the air intake flow pattern, divide the intake air, and provide a venturi effect to the air pattern resulting in an increase in air velocity with a decrease in air pressure. As the valves 1 move about their pivot mounts, the laminar wing acts as a variable sized venturi.

The movement of the two valves 1 about their respective individual pivot mounts 3 is controlled by conventional motor means (not shown) whose actuation is in turn controlled by a conventional computer central processing unit (CPU). Additional conventional sensing means (not shown) provides for the sensing of the position of the movable throttle valves 1 within the confines of the housing 5, which information is also provided to the conventional CPU.

In a similar fashion signals are provided to the two opposed fuel injectors 11 from sensing units associated with the CPU to regulate the operation of the injectors. In this manner, the amount of fuel-air being supplied to the chamber 9 is regulated. The amount of air and the amount of fuel injected into the chamber 9 may be individually regulated, by conventional control mechanisms, to be either totally shut down, totally opened, for maximum input, or any intermediated flow pattern. In FIG. 1, the two valves 1 are shown in their opened position with maximum air flow being inputted into the chamber 9. Appropriate conventional controls, as represented by the illustrated blocks, are used to control the air and fuel intake into the chamber.

After the air intake and fuel, sprayed from the injectors 11, is sent to the chamber 9, the resulting fuel-air mixture is supplied and mixed at the intake manifold, located in the flow pattern, prior to flowing to the combustion chamber 15. The combustion chamber 15 can be the internal combustion engine of a vehicle. In FIG. 1, the plenum at the intake manifold acts as the actual mixing chamber for the fuel and air thus allowing the speed of inducted air to be undiminished in the venturi by the weight of the injected fuel spray.

This design insures that the fastest venturi speed will be used, while at the same time providing for the introduction of pressurized fuel at a speed below that of the intake air flow speed without appreciably slowing down the intake air flow pattern. Test results beginning in 1989 and 1990 time frame of prototype dynos for 500 to 1000 hours of real time testing on engines for marine, light-truck and automobiles confirm this conclusion. These tests used California required 4 gas computer scope test matching to show levels of emissions on older carbureted vehicle engines to levels of at least mid 1990 standards without the benefit of catalytic converts or any other devices.

Fuel economy tests were based on the old 55 miles per hour cycle using real time and showed dramatic increases in gasoline engine mileage. It was concluded from these tests that the present invention, as compared to all known carburetors or fuel injectors tested, provided for increased acceleration using half to less that half throttle pressure. Additionally, low emissions levels for older vehicle engines permitted these engines to satisfy the rigid California state requirements thereby avoiding any state action to regulate or prohibit their operation on state roads.

Furthermore, fuel economy or a mileage increase occurred. In some cases the fuel mileage increase was as great as 42 percent on stock production engines and 25–28 percent on high performance engines. Miles per gallon increases were 12 miles per gallon or more on stock, unmodified factory configurations. Pending further tests, increases in gasoline mileage for more modern fuel efficient intake manifolds, exhaust systems and ignitions systems are currently unknown. It is fully anticipated that the current invention will function perfectly with lean airfuel ratios to yield high gasoline mileage increases. Such benefits are attainable for automotive, truck, marine, and aircraft engines, including two-cycle applications.

The system disclosed can provide for a fuel flow pressure or flow rate over a large range of pressure and flow rates. Additionally, the system is capable of being calibrated for either liquid or gaseous fuels. At maximum air intake flow speeds the flow is approximately 700 miles per hour(mph).

This invention can work on naturally aspirated, turbocharged, or supper charged engines to enhance their performance to levels never experienced. Precise controls are possible in the 0–16,000 revolutions per minute (rpm) engine speed range with both ignition and fuel safety cut-offs electronically programmable to any specification. The invention can be an open or closed loop. Envisioned in the total system are the Central Processing Unit (CPU), previously mentioned, the injector as shown, throttle position sensor (tps), several engine sensors, and programs for use by the user or by an off site modem linked to a remote technical center.

Figure 2:
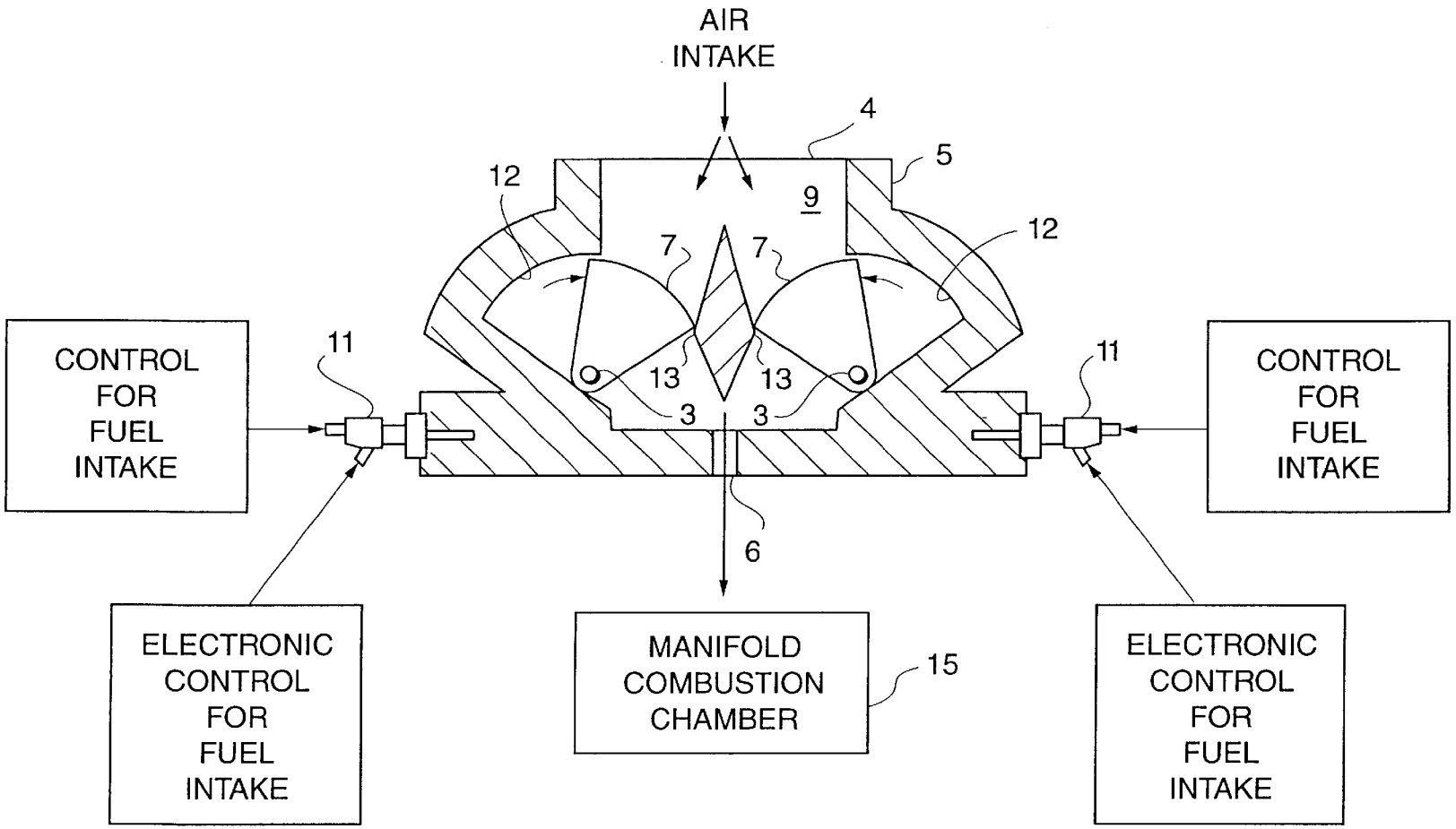
FIG. 2 is a side cross section view of the invention with the air throttle valves in a closed position.

FIG. 2 is a side cross section view of the invention with the two air throttle valves 1 in a closed position. In this position only a slight amount of intake air is supplied to the manifold of the combustion chamber 15 as side protrusions 13 of center wing 7 contact the adjacent sides of the two valves 1. The supply of fuel from the two injectors 11 can be closed down at the same time to eliminate any fuel or air being supplied to the manifold of the combustion chamber 15.

In the set up shown in FIGS. 1–2, the center laminar wing 7 divides the air passageway formed in chamber 9 into two generally equal parts. The fuel from the two side injectors 11 is introduced into this formed intake air flow pattern at an angle of approximately 60 degrees from the air throttle valves 1 by an electric constant pressure pump, or pumps. As such the total unit, within the confines of the housing 1, may be retrofitted onto the manifold of a combustion chamber 13 as a single unit. No added accelerator pumps, control valves, control diaphragm, gaskets, check valves, springs, other internal component parts, or other possible weak links, are need for use with the present invention. This reduces the numbers of parts required, typically about 350 for a carburetor and 75 for newer electronic systems, to less than 12 parts for the present invention.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A premixing fuel-air chamber comprising:

a hollow interior housing having an air intake inlet on one side and a fuel-air outlet on the opposite side of the housing;

a laminar air flow wing fixed within the interior of said hollow housing to divide the housing into two air passageways of approximately the same size;

two movable air throttle valves fixed to the interior of said housing with one on each side of said two air passageways formed by the laminar flow wing, said throttle valves being movable from a position out of the air flow passageway formed by the laminar flow wing to a position whereby each valve engages the laminar flow wing to obstruct the passage of intake air past the wing; and two pressurized side fuel injectors mounted on opposite sides of said housing and positioned to discharge fuel within the interior of said housing adjacent the fuel-air outlet and below the laminar flow wing.

2. The premixing fuel-air chamber as claimed in claim 1 combined with the manifold of a combustion engine, wherein the manifold of the combustion engine is in fluid communication with the fuel-air outlet from the premixing fuel-air chamber.

3. The combination as claimed in claim 2, wherein said air throttle valves are substantially identical in shape and each is mounted by a pivot joint to the interior of said housing.

4. The combination as claimed in claim 3, wherein said housing has internal side seating cut out portions which permit the two throttle valves to move completely out of the air passageways formed by the laminar flow wing within the housing.

5. The combination as claimed in claim 4, wherein said side fuel injectors are oriented to spray at an angle of approximately 60 degrees with respect to the laminar air flow wing.

6. The combination as claimed in claim 5, wherein said housing has two internal side cut out portions used to seat the two air throttle valves, each of said cut out portions having approximately the same size and shape as the air throttle valve which seats in the cut out portion.

7. The combination as claimed in claim 6, wherein the two air throttle valves are substantially identical in size and shape.

* * * * *

UNITED STATES PATENT AND TRADEMARK OFFICE

CERTIFICATE OF CORRECTION

PATENT NO. : 6,290,215 B1
DATED : September 18, 2001
INVENTOR(S) : Michael Pinsker It is certified that error appears in the above-identified patent and that said Letters Patent is hereby corrected as shown below:

Column 4,
Line 55, change "supper charged" to -- supercharged --.

Signed and Sealed this

Second Day of April, 2002

*Attest:*

*Attesting Officer*

JAMES E. ROGAN
*Director of the United States Patent and Trademark Office*